US009793671B2

(12) United States Patent
Schuetz

(10) Patent No.: US 9,793,671 B2
(45) Date of Patent: Oct. 17, 2017

(54) WIRE POSITIONING DEVICE

(75) Inventor: Peter Schuetz, Solingen (DE)

(73) Assignee: SCHLEUNIGER HOLDING AG, Thun (CH)

( * ) Notice: Subject to any disclaimer, the term of this patent is extended or adjusted under 35 U.S.C. 154(b) by 416 days.

(21) Appl. No.: 14/354,589

(22) PCT Filed: Aug. 14, 2012

(86) PCT No.: PCT/IB2012/054137

§ 371 (c)(1),
(2), (4) Date: Apr. 30, 2014

(87) PCT Pub. No.: WO2013/064916

PCT Pub. Date: May 10, 2013

(65) Prior Publication Data

US 2014/0283382 A1 Sep. 25, 2014

Related U.S. Application Data

(60) Provisional application No. 61/554,765, filed on Nov. 2, 2011.

(30) Foreign Application Priority Data

Nov. 2, 2011 (EP) ..... 11187480

(51) Int. Cl.
*H01R 43/052* (2006.01)
*H01R 43/28* (2006.01)

(52) U.S. Cl.
CPC ..... *H01R 43/052* (2013.01); *H01R 43/28* (2013.01); *Y10T 29/49185* (2015.01); *Y10T 29/53235* (2015.01); *Y10T 29/53261* (2015.01)

(58) Field of Classification Search
CPC ..... H05K 43/00; H05K 43/04; H05K 43/048; Y10T 29/5313; Y10T 29/53274;
(Continued)

(56) References Cited

U.S. PATENT DOCUMENTS 3,455,006 A 7/1969 Reem et al.
3,769,681 A * 11/1973 Eubanks ..... H01R 43/052 29/564.4

(Continued)

FOREIGN PATENT DOCUMENTS

EP 0813271 A2 12/1997
GB 2021988 A 12/1979

(Continued)

OTHER PUBLICATIONS

International Search Report and International Preliminary Report on Patentability, dated Dec. 21, 2012, from parent application PCT/IB2012/054137; in English.

(Continued)

*Primary Examiner* — Carl Arbes
(74) *Attorney, Agent, or Firm* — Davis & Bujold PLLC; Michael J. Bujold

(57) ABSTRACT

Wire positioning devices (1) for positioning an electrical wire (2) in a processing device, include a wire guide (4) for receiving the electrical wire (2) and a lowering device (5), movable vertically in relation to a first longitudinal axis (45) of the wire (2) received in the wire guide (4). The lowering device (5) has a press piece (6), spring-loaded via at least one spring element (15), and is provided so as to be contacted against the wire guide (4), the spring element (15) being arranged in a tube (16). Also disclosed are methods for lowering thin wires (2) and for positioning them in an oscillation-damped manner, wherein a wire positioning device (1) or a processing device are employed.

12 Claims, 4 Drawing Sheets

Figure 1:
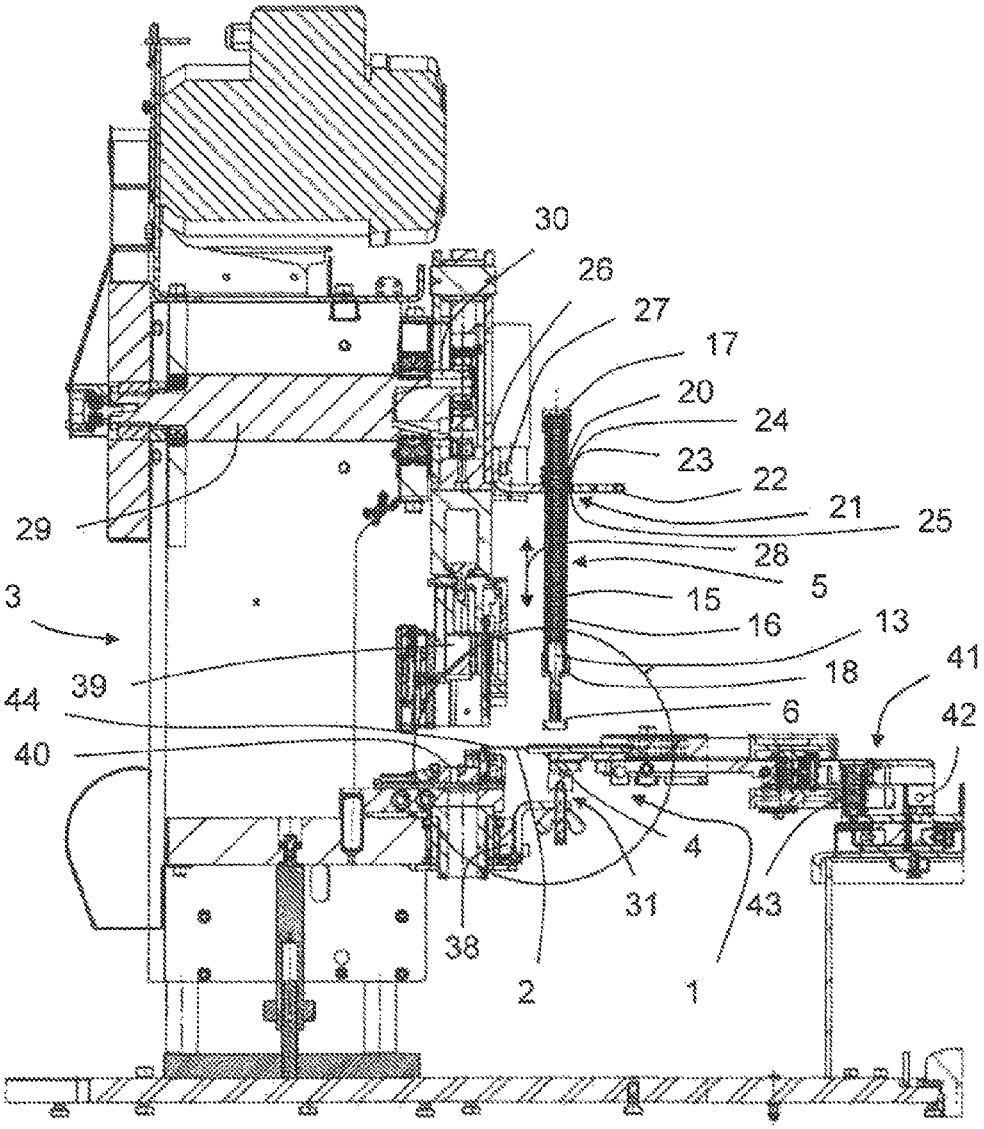

(58) Field of Classification Search
CPC ..... Y10T 29/49185; Y10T 29/53235; Y10T 29/53261; H01R 43/052; H01R 43/28
See application file for complete search history.

(56) References Cited

U.S. PATENT DOCUMENTS

| | | | | | |
|---|---|---|---|---|---|
| 3,918,330 | A | | 11/1975 | Blaha | |
| 4,164,808 | A | | 8/1979 | Gudmestad et al. | |
| 4,361,942 | A | * | 12/1982 | Mazzola | H01R 43/052 29/33 M |
| 4,521,946 | A | | 6/1985 | Dusel et al. | |
| 4,581,796 | A | * | 4/1986 | Fukuda | H01R 43/28 29/33 M |
| 5,367,767 | A | | 11/1994 | Deuel et al. | |
| 5,943,751 | A | | 8/1999 | Kamei | |
| 6,266,870 | B1 | * | 7/2001 | Wollermann | H01R 43/01 29/564.4 |
| 7,774,927 | B2 | | 8/2010 | Karrasch et al. | |
| 2001/0000367 | A1 | | 4/2001 | Conte | |
| 2010/0212147 | A1 | * | 8/2010 | Malstrom | H01R 43/058 29/753 |
| 2010/0269332 | A1 | * | 10/2010 | Wasilko | H01R 43/052 29/753 |

FOREIGN PATENT DOCUMENTS

| | | | | |
|---|---|---|---|---|
| JP | S54-065392 | U | | 5/1979 |
| JP | 9063736 | A | * | 3/1997 |
| WO | 2008/087938 | A1 | | 7/2008 |
| WO | 2009/017653 | A1 | | 2/2009 |
| WO | 2011/004272 | A1 | | 1/2011 |

OTHER PUBLICATIONS

EPO search report and written opinion from priority EPO application EP11187480, dated Apr. 2, 2012, in German.

* cited by examiner

WIRE POSITIONING DEVICE

This application is a 35 U.S.C. 371 national-phase entry of PCT International application no. PCT/IB2012/054137 filed on Aug. 14, 2012 and also claims benefit of priority to prior European application no. EP11187480 filed on Nov. 2, 2011, and also claims priority as a non-provisional of U.S. provisional application Ser. No. 61/554,765 filed on Nov. 2, 2011, and both European application no. EP11187480 and U.S. provisional application Ser. No. 61/554,765, as well as parent PCT International application no. PCT/IB2012/054137, are all incorporated herein by reference in their entireties for all intents and purposes, as if identically set forth in full herein.

The invention relates to a wire positioning device for positioning an electrical wire in a processing device. The invention further relates to a processing device, comprising a processing station and a wire positioning device of this type. The invention further relates to a method for lowering thin wires and for positioning them in an oscillation-damped manner, or in a manner so that oscillations of the wire and/or guide parts are minimized.

A device of this type and a method for lowering and positioning wires in a processing station, formed as a crimping station, of a processing device is described in prior WO 2009/017653A1.

IN THE CONVENTIONAL PRIOR ART

A pivoting gripper or guide mounted on a movable carriage grasps the wire at the insulation close to a stripped wire end and moves in front of the crimping station, where it positions the stripped wire end, for example a conductive wire or a stranded wire, approximately above the lower crimp anvil and above a contact element to be crimped. The crimping process is then started. The plunger moves downward with momentum by a stroke of approximately 30 to 60 mm, contacts the upright gripper head or guide in the manner of a hammer during the last 8 to 10 mm and presses downward the spring-loaded gripper or guide with the wire. The wire is thus introduced into the crimp wings of the contact element, without significant deflection, provided it has a sufficiently large wire cross-section, and the insulated part of the wire and/or the stripped part is/are crimped simultaneously on the lower anvil by the upper punch of the crimping tool via an insulation and/or conductor crimp wings. At the same time, the carrier strip is separated from the terminal by a separating punch.

Once crimping is complete, the crimping tool moves back up into its upper position and the gripper or guide likewise springs back. The spring travel of conventional grippers and guides is approximately 16 mm.

Conventional wires fitted in cars (0.35 to 6 $mm^2$) are relatively easy to handle, even though they deflect and vibrate slightly when pressed downward with momentum. However, with these larger wire sizes no considerable difficulties are encountered during the crimping process.

Very thin wires such as 0.13 $mm^2$ are being increasingly installed in cars, however. Even wires having a wire cross-section of 0.05 $mm^2$ are being considered. However, such thin wires can no longer be processed using conventional techniques.

Many thin wires have special insulation which has high tensile strength because the insulation also has to withstand some of the tensile force. The thin wires continue to oscillate after they move into position over crimp wings when they are positioned using conventional grippers or guides. The wire cannot be controlled and introduced reliably into the crimp wings of a contact element during the stroke motion of the crimping tool, and as a result, the wire may not be captured properly within the crimp wings.

WO 2009/017653A1 discloses a wire positioning device intended to overcome such a drawback. The wire positioning device is arranged on a base frame. The wire positioning device according to WO 2009/017653A1 has a gripper or a guide and is mounted on a rotating plate which moves the wire in the A, B and C planes. For vertical positioning, the gripper has cylindrical guide rods with teeth, which are connected to a gearwheel of a horizontally arranged driveshaft of a servomotor and convert the rotary motion into a vertical motion. The height and spacing can also be controlled, however, by hydraulics or other drive means.

The crimping tool comprises a stationary anvil and movable upper crimping punch, which is moved vertically by a stroke of the crimping station. The servomotor of the wire positioning device moves the end of the wire, once it has been positioned above an electrical contact element arranged on the anvil, into the open insulation and/or strand claw of the contact element by lowering. The contact element is then crimped to the wire.

With a wire positioning device of this type, the wire can be lowered more slowly. However, synchronisation is extremely difficult because it cannot be easily controlled. In addition, an additional servomotor increases the cost of the wire positioning device considerably. A reduction in the lowering speed may then also have a negative effect on productivity.

To overcome these drawbacks, a device for lowering and positioning thin wires in a crimping station is known from WO 2011/004272A1, said device having a press base frame having a drive, which moves a press carriage along a central axis with a speed variation similar to a sine curve from an upper dead center to a lower dead center and back, a central plunger which is arranged parallel to the central axis and is fixed at one end to a holder, via which the plunger is connected rigidly to the press carriage of the crimping station so that the press carriage and plunger move synchronously in a downward stroke, a separate gripper with a gripper head and at least one pair of gripper jaws, by means of which the gripper positions at least one wire end of a conductor in a crimping zone of a crimping tool arranged on the press carriage and having a crimping tool upper part and a crimping tool lower part in a defined pivot-in position for crimping with crimp wings of a contact element, wherein at least one leading lowering device, which actuates the gripper head in a leading position in relation to the downward stroke of the plunger and lowers it in a leading position with reduced speed and thus moves the wire end from the pivot-in position into a defined crimping position, is assigned to or coordinated with the central plunger.

A drawback of the wire positioning device described in WO 2011/004272A1 is the high level of structural complexity and the associated high production costs.

GB 2021988A, referred to hereinafter as D1, describes a processing device comprising a processing station and a wire positioning device, as shown in particular in its FIG. 30. The processing station comprises a head 606, which is movable vertically in relation to the longitudinal axis of a wire and has a cutting knife 630 and a crimping element 631 inter alia. The wire positioning device comprises upper and lower positioning elements 408, 409 ("wire gathering heads"), which are movable vertically in relation to the longitudinal axis of the wire. The positioning elements 408, 409 can be transferred into an open position and into a closed position, as is shown in FIGS. 30 and 31 of D1, wherein, in the closed position, the positioning elements 408, 409 engage in one another in such a way that they surround the wire so as to hold it in its position as it is cut and stripped (in particular see page 10, lines 55 to 124).

In contrast to the invention, the movable head 606 described in D1 and comprising the element 640 is part of the processing station. It is therefore not part of the wire positioning device, as is provided in the invention, since the movable head 606 has tools, such as the cutting knife 630 and the crimping element 631, which process the wire for further use. The wire positioning device of D1 is, by contrast, formed by the positioning elements 408, 409 Inter alia, which are then also to be compared to the lowering device according to the invention. If the positioning elements 408, 409 are compared to the lowering device according to the invention, the difference between D1 and the invention lies in the fact that the positioning elements 408, 409 are not designed in the form of a press piece within the meaning of the invention and also do not have a spring element arranged in a tube. By contrast, the positioning elements 408, 409 of D1 are moved into a closed position and into an open position in an unsprung manner.

U.S. Pat. No. 4,521,946A—referred to hereinafter as D2—describes a conveying system for wires 116 that have already been cut, wherein the cut wires 116 are transported between two mutually opposed belts 52, 54. In an embodiment of D2, as shown in FIGS. 15, 16 and 17 of D2, the upper belt 52 is connected to a conveying means 112 and the lower belt 54 is connected to a separator 68. The wires 116 are split by means of the separator 68 and are forwarded to different processing stations (in particular see D2, column 6, lines 27 to 38). The separator 68 has a pneumatic cylinder 172 to move the separator 68 accordingly so that it can split the wires and separate them from one another (in particular see D2, column 6, lines 44 to 47).

By contrast, a wire positioning device according to an embodiment of the invention comprises a lowering device with a press piece and a spring element arranged in a tube. This is not disclosed in D2.

FIGS. 15, 16 and 17 of D2 do not describe a wire positioning device within the meaning of the invention. By contrast, a completely different object compared to that to be achieved by the present invention, namely the separation of wires so that the separated wires can be fed to different processing stations, is pursued with the conveying system described in reference D2, and therefore the disclosure of D2 is in not believed comparable with the present subject matter.

EP 0813271A2—referred to hereinafter as D3—describes a device for producing a cable harness, in which connection elements 13a, 13b are arranged in a clamping and shifting unit 14 at the two ends 8, 10 of a wire 1. The wire 1 is clamped in two clamps 24a, 24b for this purpose, said clamps being driven by piston cylinders 25a, 25b (in particular see D3, column 5, lines 18 to 32). A wire positioning device comprising an embodiment of the invention is also not disclosed in D3, since D3 does not disclose a press piece and a lowering device having a spring element arranged in a tube.

An object of the present invention is therefore to create a solution by means of which the structural complexity of a wire positioning device and therefore of a processing device for an electrical wire can be reduced and by means of which selective positioning of an electrical wire in a processing station of a processing device can also be achieved.

A further object of the invention is to create a method which can be carried out in a cost effective manner and which, in particular, is suitable for the positioning of thin electrical wires.

Advantageous developments are illustrated in the figures and the present disclosure.

In accordance with the invention, the wire positioning device is characterised in that the lowering device has a pressure piece, which is spring-loaded by at least one spring element and is provided so as to be contacted against the wire guide or gripper, the at least one spring element being arranged in a tube.

When a wire is supplied by the wire positioning device, the wire guide or gripper and the free end of the wire protruding from the wire guide or gripper oscillate in both horizontal and vertical directions relative to the longitudinal axis of the wire. The oscillation of the wire is due to the filigree structure of a thin wire and the resultant likewise relatively thin design of the wire guide, which may be embodied for example in the form of a thin guide tube, from which a free end of the wire, preferably a partially bared end of the wire, protrudes. This oscillatory movement of the wire guide or gripper together with the wire introduced therein can be interrupted by a lowering of the lowering device and by the resultant contact of the pressure piece of the lowering device against the wire guide or gripper. The pressure piece is applied directly to the wire guide or gripper as a result of a movement of the lowering device vertically in relation to the longitudinal axis of the wire received in the wire guide or gripper, in such a way that the pressure piece comes to rest against an upper face of the wire guide.

The pressure piece preferably has a block or a plate, on which a flat contact surface is formed, by means of which the pressure piece is brought to rest against the wire guide or gripper when the lowering device is lowered. The pressure piece can also be formed as a hard rubber buffer, however, with a flat or slightly crowned contact surface. The pressure piece is mounted in the lowering device in a spring-loaded manner via at least one spring element, which is preferably embodied in the form of one or more compression springs, in such a way that the pressure piece can carry out a vertical movement in relation to the longitudinal axis of the electrical wire, guided by the spring element. The pressure piece can be connected to the spring element either directly or via an intermediate element, such as a pin. The pressure piece is guided movably within the lowering device via the spring element, which is arranged in a tube. When the wire guide or gripper is positioned, the lowering device and hence, the pressure piece is moved downward. When the pressure piece makes contact with the wire guide or gripper, the wire guide or gripper can initially be accelerated as smoothly as possible because of the spring force. Once a height of insertion desired for the processing, in the processing station, of the free end of the wire protruding from the wire guide has been reached, the guide or gripper is captured between the pressure piece and the lower stop. As a result, the oscillation of the wire guide or gripper and therefore of the free end, protruding from the wire guide, of the wire received therein may be stopped. If the oscillations of the wire guide or gripper and the free end of the wire protruding from the wire guide or gripper are significantly reduced, the positioning accuracy of the free wire end in the processing station, for example a crimping station, is much higher due to the fact that there is now no inherent movement of the free end of the wire. Due to the arrangement of the spring element in a tube, it is possible to position and guide the spring element within the lowering device in a precise manner. In particular, lateral tilting of the spring element, which is preferably embodied in the form of a spiral spring, is thus prevented. Due to the wire positioning device according to the invention, the wire may be positioned in a processing station of a processing device with a high level of repetition accuracy. By means of the spring-loaded pressure piece, the oscillations of the wire guide of the free end of the wire protruding from the wire guide may be reduced within a short period of time, and therefore the overall processing time of an electrical wire in a processing station of a processing device can be reduced, whereby processing can be carried out more economically.

The spring-loaded pressure piece thus replaces the costly and complex servomotor or central plunger lowering devices, known from the prior art and has a substantially simpler design than these. Due to the relatively simple structural design of the device according to the invention, the production costs of a wire positioning device can also be reduced considerably compared to conventional wire positioning devices.

In accordance with a preferred embodiment of the wire positioning device, a stop element is arranged opposite the pressure piece, which captures the wire guide or gripper between the pressure piece and the stop element thereby significantly reducing any oscillation. The stop element is preferably positioned below the wire guide or gripper when the electrical wire is introduced into the processing station of the processing device. The pressure piece of the lowering device is positioned above the wire guide so that the pressure piece and the stop element are basically opposite one another. When the pressure piece rests on an upper face of the wire guide, the wire guide, which is still oscillating, can be pressed downward by means of the pressure piece in the direction of the stop element until the wire guide lies directly or indirectly via its lower face on the stop element arranged below the pressure piece so that the wire guide is clamped between the pressure piece and the stop element in an oscillation-damped manner, whereby the oscillation of the wire guide and therefore also of the free end of the electrical wire protruding from the wire guide can be minimised or stopped particularly quickly and effectively. The repetition accuracy and the precision of the processing of the electrical wire received in the wire guide or gripper in the processing station of the processing device can thus be further improved.

Furthermore, the pressure piece of the lowering device is preferably arranged with a second longitudinal axis above the wire guide, and the stop element is preferably arranged with a third longitudinal axis below the wire guide, the pressure piece being arranged with the second longitudinal axis vertically in relation to the first longitudinal axis, and the stop element being arranged with the third longitudinal axis vertically in relation to the first longitudinal axis. It can thus be ensured that the pressure piece and the stop element each lie with the contact surfaces against the wire guide in a flat or slightly crowned manner to damp the oscillation of the wire guide, whereby oscillation of the wire guide is damped particularly quickly and effectively.

It is further preferable for the second longitudinal axis of the pressure piece to be arranged offset in relation to the third longitudinal axis of the stop element along the first longitudinal axis of the electrical wire.

In accordance with a further advantageous embodiment of the wire positioning device, the tube of the lowering device that holds the spring has an outer thread, which engages in a holding element having an inner thread. An outer thread can be formed on the outer peripheral surface of the tube, in which a holding element provided with an inner thread can engage. The tube in which the spring element is arranged can thus be positioned and fixed on the holding element. In addition, the tube and therefore the spring element can be easily fixed to the holding element by hand and adjusted at the same time via the outer thread and the inner thread engaging therein, without the need for further tools for this purpose. The effort required to form the wire positioning device can thus be reduced further. For example, the holding element may have a flange and a sleeve, wherein the sleeve can be fixed at a through-opening formed in the flange, and an inner thread, in which the outer thread of the tube can engage, can be formed on the inner wall of the sleeve so that the tube can be guided through the sleeve and the through-opening formed in the flange. The holding element can then be fixed via the flange to the processing station of the processing device.

Furthermore, the wire positioning device preferably has a mounted pivoting conveyor, the wire guide being fixed to the pivoting conveyor. The wire to be processed can be held and transported in the pivotably mounted pivoting conveyor for example, since the wire is clamped between conveyor belts or pressure rollers formed on the pivoting conveyor. Starting from the fixing of the electrical wire on the pivoting conveyor, the wire and in particular the free end of the wire can be guided through the wire guide, which is arranged on the pivoting conveyor. The pivoting conveyor enables lateral pivoting of the wire fixed in the pivoting conveyor and guided in the wire guide, in the direction of the processing station of the processing device in which the free end of the wire protruding from the wire guide is crimped for example.

Furthermore, the invention is characterised by a processing device, in particular a crimping device, for an electrical wire, said processing device having a processing station and a wire positioning device. A processing device which has a wire positioning device according to the invention is characterised by a high level of positioning accuracy of the wire to be processed in the processing station of the processing device, wherein this can be achieved with a low level of structural complexity of the overall processing device. For example, if the processing device is a crimping device, a free end of the wire to be processed can be positioned with as little oscillation as possible in the processing station in crimping claws of a contact part provided in a crimping tool. The quality of the processing operation, in particular of the crimping operation, of a wire can thus be improved considerably, wherein the wire can also be processed within a relatively short period of time so that the wire can be processed in a highly economical manner.

The processing station preferably has a movable carriage, the lowering device of the wire positioning device preferably being arranged on the movable carriage. The movable carriage is preferably used so that part of the processing station of the processing device can be moved back and forth in a vertical direction. If the lowering device of the wire positioning device is arranged on the movable carriage, the movement of the lowering device vertical to the longitudinal axis of the wire received in the wire guide may be ensured by the movable carriage, and therefore additional aids, such as an additional drive on the lowering device itself, are not required to move the lowering device. The structural complexity of the processing device may thus be reduced further.

Furthermore, the stop element of the wire positioning device is fixed to a rigidly positioned carrier element of the processing station. In this case, 'rigidly positioned' means that the carrier element is arranged in the processing station in a non-displaceable or Immobile manner. The stop element is preferably likewise arranged rigidly on the carrier element so that there can preferably be no relative displacement between the carrier element and the stop element. The stop element can thus form a secure, fixedly positioned counter pressure element for the pressure piece when the wire guide is pushed against the stop element by means of the pressure piece. Alternatively it is also possible, however, for the stop element to be movable vertically to the longitudinal axis of the wire received in the wire guide, similarly to the lowering device, so that the pressure piece and the stop element can be moved toward one another.

In accordance with the invention, the method is characterised in that a wire positioning device and a processing device according to the present disclosure are used.

In accordance with the method according to the invention, the lowering device is moved with the pressure piece from a first position into a second position. In the first position, the pressure piece is located above the upper face of the wire guide and distanced therefrom. The pressure piece has reached the second position as soon as it contacts the upper face of the wire guide, which leads to a first damping of the oscillation of the wire guide and of the wire. As the lowering device is lowered further, the pressure piece is moved vertically in the direction of the tube in accordance with the spring force of the spring element or of the individual spring elements, whilst the wire guide is moved with reduced acceleration by the pressure piece in the form of a pitch movement from the second position into a third position. The third position is reached as soon as the vertical movement of the lowering device and the pitch movement of the wire guide are concluded by contact with the stop element.

Further advantages, features and details of the invention will emerge from the following description, in which an exemplary embodiment of the invention is described with reference to the drawings. The features disclosed in the claims and in the description may be essential to the invention either individually or in any combination.

The list of reference signs forms part of the disclosure. The figures are described contiguously and comprehensively. Like reference signs denote like component parts, and reference signs having different indices denote functionally like or similar component parts.

IN THE FIGURES

Figure 2:
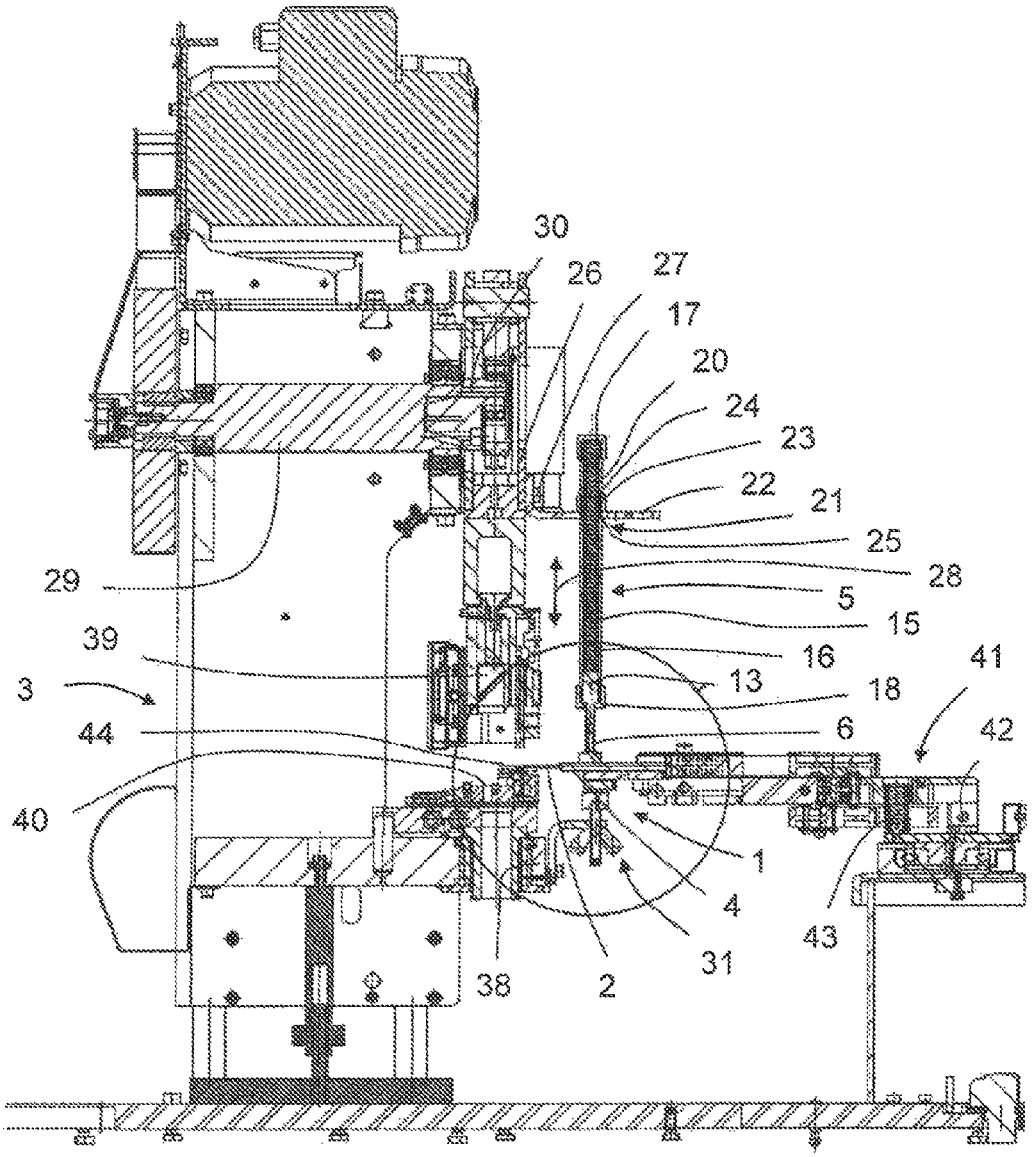
Figure 3:
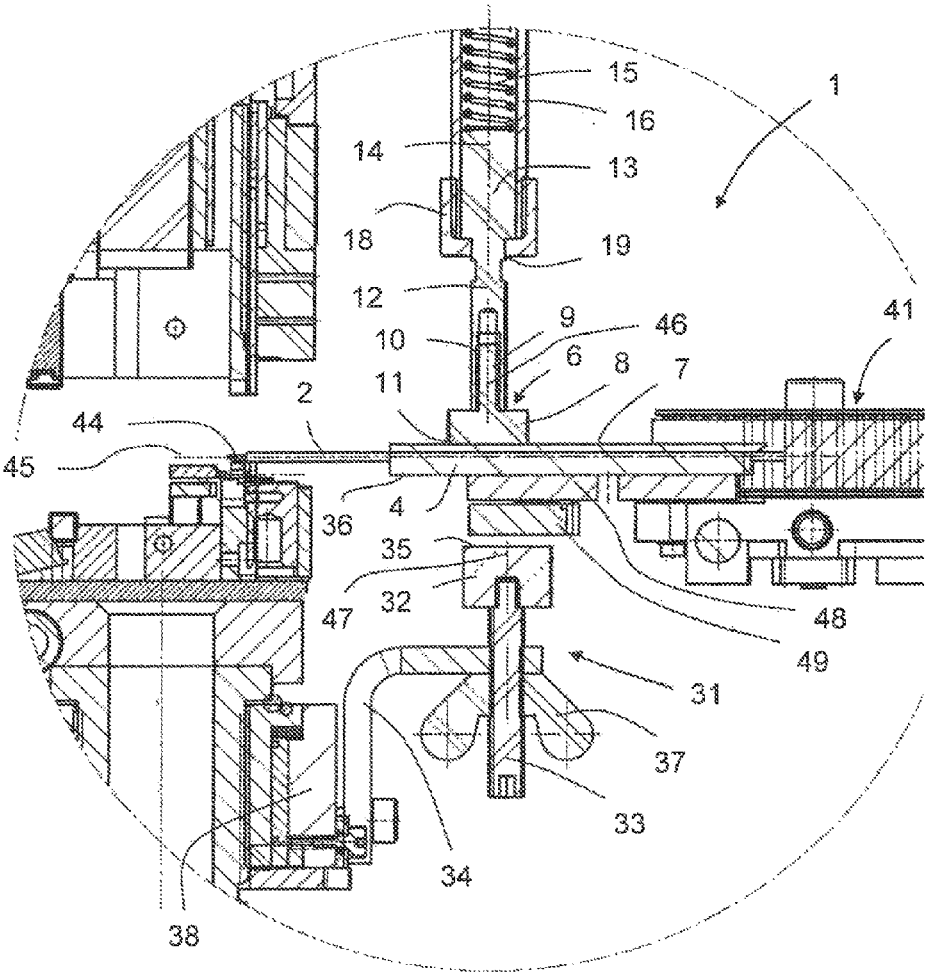
Figure 4:
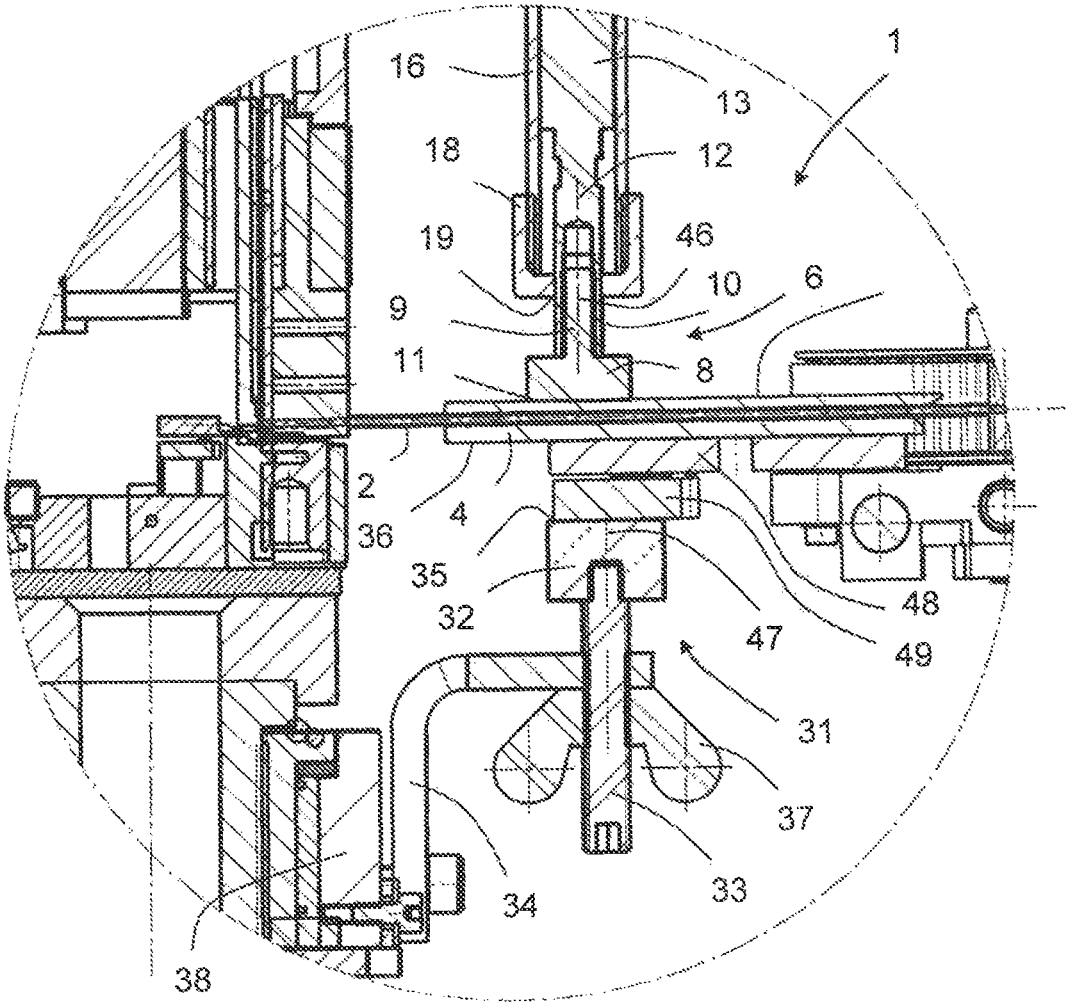

FIG. 1 shows a schematic, partial sectional illustration of a processing device having a wire positioning device in a first position, FIG. 2 shows a schematic, partial sectional illustration of the processing device having a wire positioning device in accordance with FIG. 1 in a second position, FIG. 3 shows a schematic detailed illustration of the wire positioning device shown in FIG. 2 in the second position, and FIG. 4 shows a schematic detailed illustration of the wire positioning device in a third position.

FIGS. 1 and 2 show a processing device having a processing station 3 and a wire positioning device 1 for positioning an electrical wire 2 in the processing station 3. FIG. 3 shows a detailed illustration of the wire positioning device 1 according to FIG. 2 in a second position, and FIG. 4 shows a detailed illustration of the wire positioning device 1 in a further, third position.

The processing station 3 shown in this case is formed as a crimping station, and therefore the processing device shown in this case is also a crimping device. The crimping station shown in this case has a crimping tool with an upper punch unit 39 and a lower punch unit 40. The invention is not limited to a crimping device having a crimping station, however. For example, it may also be used for soldering or welding devices.

The wire positioning device 1 has a wire guide 4, in which the electrical wire 2 is received so as to be processed in the processing station 3. The wire guide 4 is embodied in this case in the form of a guide sleeve, through which the wire 2 is guided, wherein a free end 44 of the wire 2 protrudes from the wire guide 4.

The wire positioning device 1 further has a lowering device 5, which is arranged movably vertically in relation to a first longitudinal axis 45 of the electrical wire 3 received in the wire guide 4.

The lowering device 5 has a spring-mounted pressure piece 6 at one end, which, in a second position as shown in FIGS. 2 and 3, comes to rest against an upper face 7 of the wire guide 4. The pressure piece 6 shown in this case is basically T-shaped and has a plate 8 and a shaft 9 arranged on the plate 8, in particular as shown in FIGS. 3 and 4. The plate 8 is a hard rubber buffer with a flat or slightly crowned surface. An outer thread 10 is formed on the shaft 9, via which the pressure piece 6 can be fixed. The pressure piece 6 shown in this case is thus embodied basically in the form of a screw. The pressure piece 6 has a preferably circular contact surface 11 on the plate 8, with which the pressure piece 6 can be pressed in a planar manner against the wire guide 4, as shown in FIGS. 2, 3 and 4. In the embodiment shown in this instance, the pressure piece 6 is screwed in at a first end portion 12 of a pin 13 via the outer thread 10 formed on the shaft 9 and is fixed to the pin 13.

The pin 13 is connected to a spring element 15 at a second end portion 14 of the pin 13 opposite the first end portion 12, in such a way that the pressure piece 6 is spring-loaded via the pin 13. The spring element 15 is embodied in this case in the form of a plurality of compression springs arranged in succession. Alternatively, the spring element 15 may also be formed from a single mechanical compression spring. A small, pressurised pneumatic cylinder is also conceivable, as is a design with a press plunger guided in the tube and, for example, two outer tension springs mounted between the press plunger head and the assembly flange. The spring element 15 and the second end portion 14 of the pin 13 are arranged in a tube 16, wherein the longitudinal axis of the tube 16 extends vertically in relation to the longitudinal axis of the electrical wire 2.

The tube 16 is closed via a first cap-shaped end piece 17 and via a second cap-shaped end piece 18, wherein a through-opening 19 is formed in the second cap-shaped end piece 18, the first end portion 12 of the pin 13 being guided through said through-opening.

An outer thread 20 is formed on the outer peripheral surface of the tube 16. The tube 16 is fixed to a holding element 21 via the outer thread 20. The holding element 21 has an L-shaped, curved flange 22 and a cylindrical sleeve 23, for example for adjusting the height of introduction of the wire, wherein an inner thread 24 is formed on an inner wall of the sleeve 23 and the outer thread 20 of the tube 16 engages in said inner thread. The tube 16 is guided through a through-opening 25 formed in the flange 22. The sleeve 23, which can also be formed as a nut, is fitted on the flange 22 in the region of the through-opening 25 and is preferably fixed to the flange 22 so that the tube 16 is guided through the sleeve 23 and the through-opening 25 formed in the flange 22 and is screwed via its outer thread 20 into the inner thread 24 of the sleeve 23 so as to be fixed to the holding element 21.

The flange 22 and/or the holding element 21 preferably have at least two adjacent through-openings 25 so that the tube 16 can be installed at different locations.

The lowering device 5 is arranged via the flange 22 of the holding element 21 on a movable carriage 26 of the processing station 3 of the processing device and is fixed thereto via a screw 27. The movable carriage 26, which for example may be a press carriage, is movable in a direction 28 vertically in relation to the first longitudinal axis 45 of the wire 2 received in the wire guide 4. Since the lowering device 5 is fixed rigidly to the movable carriage 26, the lowering device 5 follows the movement of the movable carriage 26 so that the lowering device 5 is guided vertically by means of the movable carriage 26. It is therefore not necessary to provide separate drive means for the lowering device 5. The movable carriage 26 is moved via a crankshaft 29 arranged in the processing station 3 and via a crank pin 30 connecting the movable carriage 26 to the crankshaft 29.

A stop element 31 is arranged opposite the pressure piece 6, wherein the pressure piece 6 and the stop element 31 are arranged opposite one another in such a way that a second longitudinal axis 46 of the pressure piece 6 is oriented so as to be slightly offset in relation to a third longitudinal axis 47 of the stop element 31. The stop element 31 has a plate 32, which can be formed as a hard rubber buffer with a flat or slightly crowned surface, a dowel 33 screwed into the plate 32, and a flange 34, to which the dowel 33 is fixed by means of a fixing element 37. The stop element 31 has a planar contact surface 35 on its plate 32, the lower face 36 of the wire guide 4 coming to rest directly or indirectly against said contact surface when the wire guide 4 is pressed downward in the direction of the stop element 31 by means of the pressure piece 6, as shown in FIGS. 2, 3 and 4. The lower face 36 of the wire guide 4 can be supported by a first support element 48, which is arranged on the pivoting conveyor 41. In addition, a second support element 49 may be arranged on the pivoting conveyor 41 between the first support element 48 and the stop element 31 so as to further improve the stability of the pivoting conveyor 41. The stop element 31 is connected rigidly via the flange 34 to a carrier element 38 positioned rigidly on the processing station 3. The stop element 31 may alternatively also be mounted on the fixing surface of the machine, to which the press is also fixed.

The wire guide 4 is also fixed to a horizontally pivotably mounted pivoting conveyor 41, via which the wire guide 4 is pivoted in the direction of the processing station 3, together with the wire 2 introduced into the wire guide 4, before the wire 2 is processed. The pivoting conveyor 41 has a pitch axis 42, about which the oscillation-damped pivoting conveyor 41 according to FIG. 3 introduces the wire 2 gently and in an oscillation-damped manner into an opened crimping claw of a contact element according to FIG. 4 mounted in a lower punch unit 40 of the processing station 3. Due to the reduced speed of the pivoting motion about the pitch axis 42 compared to the upper punch unit 39 as a result of the spring elements 15 and due to the spring assembly 43 arranged in the pivoting conveyor 41, an oscillation of the wire guide 4 and of the free end 44 of the wire 2 protruding from the wire guide 4 is damped much quicker both in a vertical direction and in a horizontal direction compared to wire positioning devices of the prior art not having a lowering device.

Once the wire guide 4 has been pivoted in the direction of the processing station 3 together with the wire 2, the wire positioning device 1 is located in a first position, as shown in FIG. 1. In this first position, the pressure piece 6 and the stop element 31 are spaced from the wire guide 4. The free end 44 of the wire 2 protruding from the wire guide 4 oscillates freely in all directions as a result of the vibrations. So as to minimise the oscillatory movements of the wire guide 4 and of the free end 44 of the wire 2 protruding from the wire guide 4, the lowering device 5 is then moved downward in the direction of the wire guide 4 by the carriage 25 of the processing station 3 until the stop surface 11 of the pressure piece 6 rests against the upper face 7 of the wire guide 4 in accordance with FIGS. 2 and 3 and has reached a second position. In this second position, a first damping of the oscillation of the wire guide 4 and of the wire 2 occurs. Whilst the carriage 25 and the lowering device 5 connected to the carriage 25 is lowered further vertically, the pressure piece 6 resting against the wire guide 4 is also accelerated smoothly in the direction of the stop element 31 and is moved downward into a third position by means of a pitch movement. Due to the developing spring effect of the spring elements 15 arranged in the lowering device 5, the lowering speed of the pressure piece 6 is reduced considerably, however, compared to the lowering speed of the carriage 25. At the same time, the oscillatory movements are damped further, until the lower face 36 of the wire guide 4 or, indirectly as illustrated in FIG. 4, a lower face of the second support element 49, lies against the contact surface 35 of the stop element 31 once the height of introduction of the wire set for the crimping process has been reached and once the third position has thus been reached, so that the wire guide 4 is clamped between the pressure piece 6 and the stop element 31 in the third position. The oscillations of the wire guide 4 and of the free end 44 of the wire 2 protruding from the wire guide 4 are now stopped. Subsequent oscillation of the pivoting conveyor 41 is therefore no longer possible. Once the pitch movement of the pivoting conveyor 41 is concluded, the free end 44 of the wire 2 is located, in accordance with FIG. 4, in a positionally precise and oscillation-damped manner in the opened crimping claw of a contact element provided in the lower punch unit 40 for crimping by means of the upper punch unit 39, in a manner known per se. The free end 44 of the wire 2 can be processed in a particularly precise and repetition-accurate manner due to the high level of positioning accuracy of the end 44 of the wire 2 in the processing station 3, said end of the wire now being substantially free from oscillation.

List of reference labels

| | | | |
|---|---|---|---|
| 1 | wire positioning device | 26 | movable carriage |
| 2 | wire | 27 | screw |
| 3 | processing station | 28 | direction |
| 4 | wire guide | 29 | crankshaft |
| 5 | lowering device | 30 | crank pin |
| 6 | pressure piece | 31 | stop element |
| 7 | upper face | 32 | plate |
| 8 | plate | 33 | dowel |
| 9 | shaft | 34 | flange |
| 10 | outer thread | 35 | contact surface |
| 11 | contact surface | 36 | lower face |
| 12 | first end portion | 37 | fixing element |
| 13 | pin | 38 | carrier element |
| 14 | second end portion | 39 | upper punch unit |
| 15 | spring element | 40 | lower punch unit |
| 16 | tube | 41 | pivoting conveyor |
| 17 | first cap-shaped end piece | 42 | pitch axis |
| 18 | second cap-shaped end piece | 43 | spring assembly |
| 19 | through-opening | 44 | free end of the wire |
| 20 | outer thread | 45 | first longitudinal axis |
| 21 | holding element | 46 | second longitudinal axis |
| 22 | flange | 47 | third longitudinal axis |
| 23 | sleeve | 48 | first support element |

-continued

| List of reference labels | | | |
|---|---|---|---|
| 24 | inner thread | 49 | second support element |
| 25 | through-opening | | |

The invention claimed is:

1. A wire processing system comprising:

a wire processing station including a housing and a wire processing tool mounted to said housing, and said wire processing tool being configured to receive and process an end of a wire;

a movable wire guide spaced apart from said wire processing tool, and said movable wire guide being configured to receive a wire and to move an end of said wire protruding from said wire guide to said wire processing tool;

a pressure piece, including a first contact surface, movably mounted to said housing, said pressure piece being initially positioned in a first position above said wire guide when said wire guide moves said protruding end of said wire to said wire processing tool; and a stop, including a second contact surface, fixedly mounted to said housing, and said stop being positioned below said wire guide when said wire guide moves said protruding end of said wire to said wire processing tool, said pressure piece being configured, when said wire guide moves said protruding end of said wire to said processing tool, to move downwardly from the first position to a second position, where said first contact surface initially contacts an upper surface of said wire guide, and to further move downwardly, while said first contact surface presses downwardly on said upper surface, from said second position to a third position, where said second contact surface contacts a lower surface of said wire guide, either directly or indirectly, thereby stopping the motion of said wire guide induced by said pressure piece and thereby clamping said wire guide between said pressure piece and said stop, whereby oscillations of said wire guide and of said protruding end of said wire are damped prior to said protruding end of said wire being received and processed by said wire processing tool.

2. The wire processing system claimed in claim 1, wherein said wire processing tool includes a crimping tool.

3. The wire processing system claimed in claim 1, further comprising: a tube movably mounted to said housing; and a spring, encased by said tube and operatively connected to said pressure piece, said spring being configured to bias said pressure piece downwardly toward said wire guide when said wire guide moves said protruding end of said wire to said wire processing tool.

4. The wire processing system claimed in claim 3, further comprising an L-shaped flange movably mounted to said housing, said L-shaped flange including a cylindrical sleeve having an inner threaded surface, and said tube including an outer surface at least a portion of which is threaded, said portion being configured to engage with the inner threaded surface of said cylindrical sleeve.

5. The wire processing system claimed in claim 4, further comprising a carriage movably mounted to said housing, said L-shaped flange is fixedly mounted to said carriage, said carriage is configured to move said pressure piece, via said L-shaped flange, said tube and said spring, from said first position, to said second position and to said third position.

6. The wire processing system claimed in claim 1, further comprising a pivotably mounted pivoting conveyor, said wire guide is mounted to said conveyor, said conveyor is configured so that lateral pivoting of said conveyor serves to move said wire guide, and therefore the end of the wire protruding from said wire guide, toward said wire processing tool.

7. The wire processing system claimed in claim 1, wherein said movable wire guide includes a sleeve configured to receive said wire.

8. A wire processing station comprising:

a housing and a wire processing tool mounted to said housing, and said wire processing tool being configured to receive and process an end of a wire moved to said wire processing tool by a movable wire guide;

a pressure piece, including a first contact surface, movably mounted to said housing, said pressure piece being initially positioned in a first position above the movable wire guide when the movable wire guide moves a protruding end of the wire to said wire processing tool; and a stop, including a second contact surface, fixedly mounted to said housing, said stop being positioned below the movable wire guide when the movable wire guide moves the protruding end of the wire to said processing tool, said pressure piece being configured, when the movable wire guide moves the protruding end of the wire to said processing tool, to move downwardly from said first position to a second position, where said first contact surface initially contacts an upper surface of the wire guide, and to move further downwardly, while said first contact surface presses downwardly on said upper surface, from said second position to a third position, where said second contact surface contacts a lower surface of the wire guide, either directly or indirectly, thereby stopping the motion of the wire guide induced by said pressure piece and thereby clamping the wire guide between said pressure piece and said stop, whereby oscillations of the wire guide and of the protruding end of the wire are damped prior to the protruding end of the wire being received and processed by said wire processing tool.

9. The wire processing station of claim 8, wherein said wire processing tool includes a crimping tool.

10. The wire processing station of claim 8, further comprising:

a tube movably mounted to said housing; and a spring, encased by said tube and operatively connected to said pressure piece, said spring being configured to bias said pressure piece downwardly toward the wire guide when the wire guide moves the protruding end of the wire to said wire processing tool.

11. The wire processing station of claim 10, further comprising an L-shaped flange movably mounted to said housing, said L-shaped flange includes a cylindrical sleeve having an inner threaded surface, and said tube includes an outer surface at least a portion of which is threaded, and said portion is configured to engage with the inner threaded surface of said cylindrical sleeve.

12. The wire processing station of claim 11, further comprising a carriage movably mounted to said housing, said L-shaped flange is fixedly mounted to said carriage, said carriage is configured to move said pressure piece, via said L-shaped flange, said tube and said spring, from said first position, to said second position and to said third position.

* * * * *